United States Patent [19]

Sogawa

[11] Patent Number: 4,903,660

[45] Date of Patent: Feb. 27, 1990

[54] FUEL INJECTION CONTROL SYSTEM FOR AN AUTOMOTIVE ENGINE

[75] Inventor: Yoshiyuki Sogawa, Tokyo, Japan

[73] Assignee: Fuji Jukogyo Kabushiki Kaisha, Tokyo, Japan

[21] Appl. No.: 270,654

[22] Filed: Nov. 14, 1988

[30] Foreign Application Priority Data

Nov. 19, 1987 [JP] Japan ..... 62-293759
Nov. 19, 1987 [JP] Japan ..... 62-293760
Nov. 19, 1987 [JP] Japan ..... 62-203761

[51] Int. Cl.[4] ..... F02D 41/08
[52] U.S. Cl. ..... 123/339; 123/478
[58] Field of Search ..... 123/339, 340, 478, 480, 123/585, 587, 588, 589; 364/431.05

[56] References Cited

U.S. PATENT DOCUMENTS 4,506,639 3/1985 Murakami ..... 123/339
4,570,592 2/1986 Otobe ..... 123/339
4,700,675 10/1987 Otobe et al. ..... 123/339
4,708,109 11/1987 Takao ..... 123/339
4,727,844 3/1988 Morita et al. ..... 123/339 X
4,821,698 4/1989 Atago et al. ..... 123/339 X
4,838,223 6/1989 Tanabe et al. ..... 123/478 X

FOREIGN PATENT DOCUMENTS 0032913 3/1980 Japan .

*Primary Examiner*—Willis R. Wolfe
*Attorney, Agent, or Firm*—Martin A. Farber

[57] ABSTRACT

A system for controlling fuel injection of an engine having a bypass around a throttle valve, and idle speed control valve provided in the bypass, and a fuel injector. A basic injection pulse width is decided in accordance with engine speed and throttle position of the throttle valve. The system has a detector detecting idling operation of the engine, for producing an idle signal, and a controller for producing a control value signal for controlling the idle speed control valve in accordance with engine speed upon the idle signal. The basic injection pulse width is corrected with a correction value relative to the control value signal.

3 Claims, 9 Drawing Sheets

FUEL INJECTION CONTROL SYSTEM FOR AN AUTOMOTIVE ENGINE

BACKGROUND OF THE INVENTION

The present invention relates to a system for controlling the fuel injection of an automotive engine in dependence on a throttle opening degree and engine speed. In a known fuel injection system, a basic fuel injection pulse width Tp is calculated in dependence on throttle opening degree O and engine speed N. The basic pulse width Tp are stored in a table shown in FIG. 5 and are derived for controlling the fuel injection during the operation of the engine. The basic fuel injection pulse width Tp is corrected in dependence on various factors such as engine speed, pressure in an intake passage, coolant temperature and vehicle speed, so that air-fuel mixture is prevented from becoming rich or lean (see for example, Japanese Patent Laid Open No. 55-32913).

There is an engine having an idle speed control valve provided in a bypass around a throttle valve. The idle speed control valve may be used for adjusting the amount of intake air at a low engine speed or at idling of the engine. In the air-fuel ratio control system where the air-fuel ratio is determined by throttle valve opening degree and engine speed, mass air flow or intake air pressure is not directly measured. Accordingly, if an opening area or cross sectional area 1 of the bypass is changed by the idle speed control valve to change the amount of intake air, the air-fuel ratio is deviated from a desired value.

SUMMARY OF THE INVENTION

The object of the present invention is to provide a system having an idle speed control valve which may control the fuel injection with accuracy in a low engine speed range.

In the system of the present invention, the basic pulse width is corrected by a correction value relative to a control value for the idle speed control valve.

According to the present invention, there is provided a system for controlling fuel injection of an engine for a motor vehicle having an intake passage, a throttle valve provided in the intake passage, a bypass around the throttle valve, an idle speed control valve provided in the bypass, and at least one fuel injector.

The system comprises an engine speed sensor producing an engine speed signal dependent on speed of the engine, a throttle position sensor producing a throttle opening degree signal dependent on an opening degree of the throttle valve, determining means for producing a basic injection pulse width signal in accordance with the engine speed signal and throttle opening degree signal, detector means for detecting idling operation of the engine and for producing an idle signal, control means responsive to the idle signal, and the engine speed signal for producing a control value signal for controlling the idle speed control valve, correcting means responsive to the control value signal for producing a correction value, and for correcting the basic injection pulse width signal with the correction value and for producing a fuel injection pulse width signal for operating the fuel injector.

In an aspect of the invention, the correcting means includes throttle valve opening area calculator means and bypass opening area calculator means and an adder for adding outputs of both the calculator means for producing the correction value.

In another aspect of the invention, the correcting means includes setting means responsive to the throttle opening degree signal for correcting the throttle opening degree signal whereby the basic injection pulse width signal is corrected.

The other objects and features of this invention will become understood from the following description with reference to the accompanying drawings.

DETAILED DESCRIPTION OF THE PREFERRED EMBODIMENT

Figure 1:
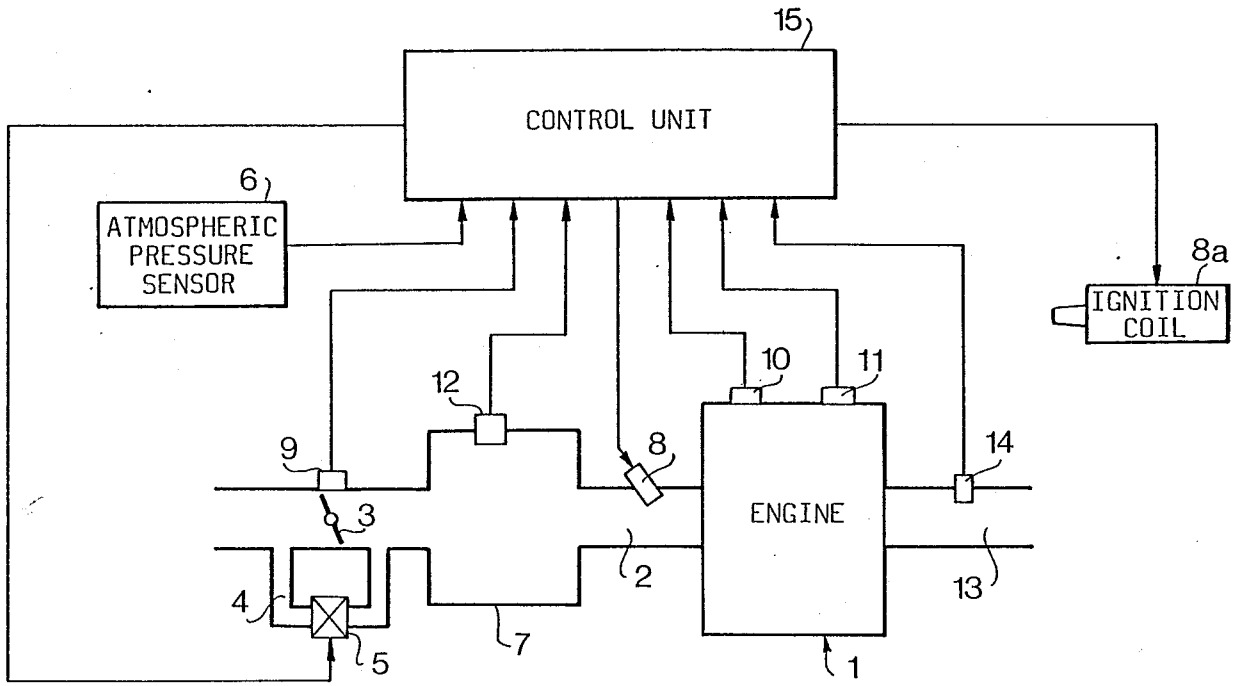
FIG. 1 is a schematic diagram showing a system according to the present invention.
Figure 4:
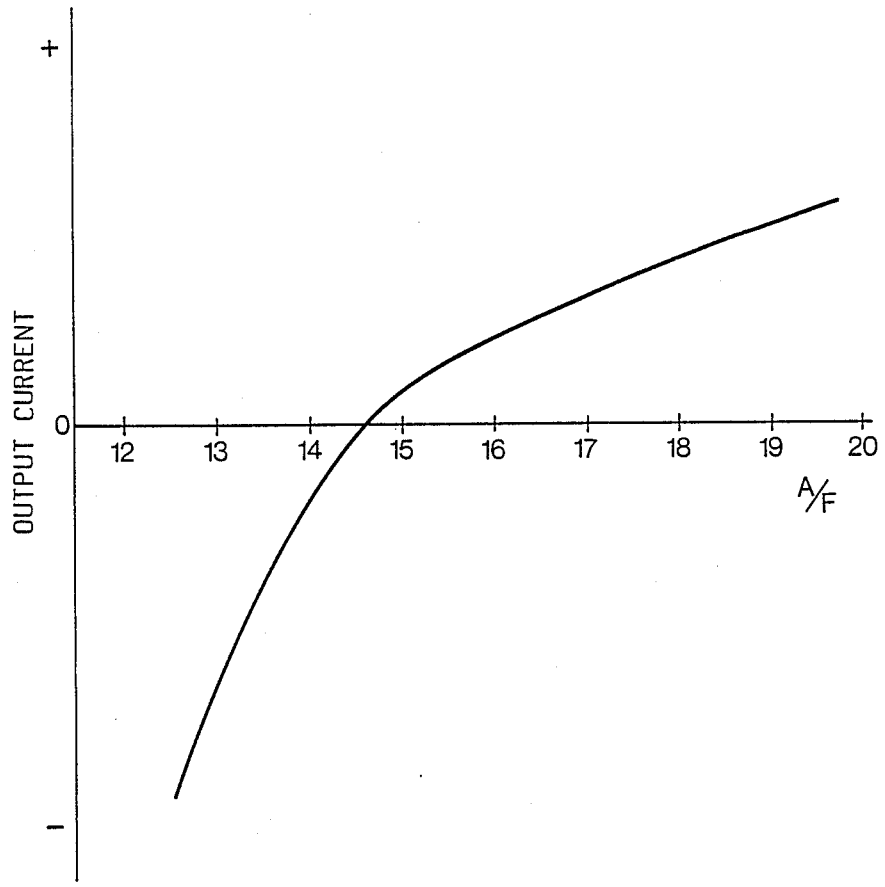
FIG. 4 is a graph showing a characteristic of an output signal of an $O_2$-sensor.

Referring to FIG. 1, in an intake passage 2 of an engine 1, a throttle chamber 7 is provided downstream of a throttle valve 3 so as to absorb the pulsation of intake air. A bypass 4 having an idle speed control valve 5 is formed around the throttle valve 3. Multiple fuel injectors 8 are provided in the intake passage at adjacent positions of an intake valve so as to supply fuel to each cylinder of the engine 1. A throttle position sensor 9, coolant temperature sensor 10, crank angle sensor 11, intake air temperature sensor 12 and an atmospheric pressure sensor 6 are provided for detecting respective conditions. An $O_2$-sensor 14 having a characteristic shown in FIG. 4 is provided in an exhaust passage 13. Output signals of the sensors are applied to a control unit 15 comprising a microcomputer to operate the fuel injectors 8 and an ignition coil 8*a* .

Figure 2:
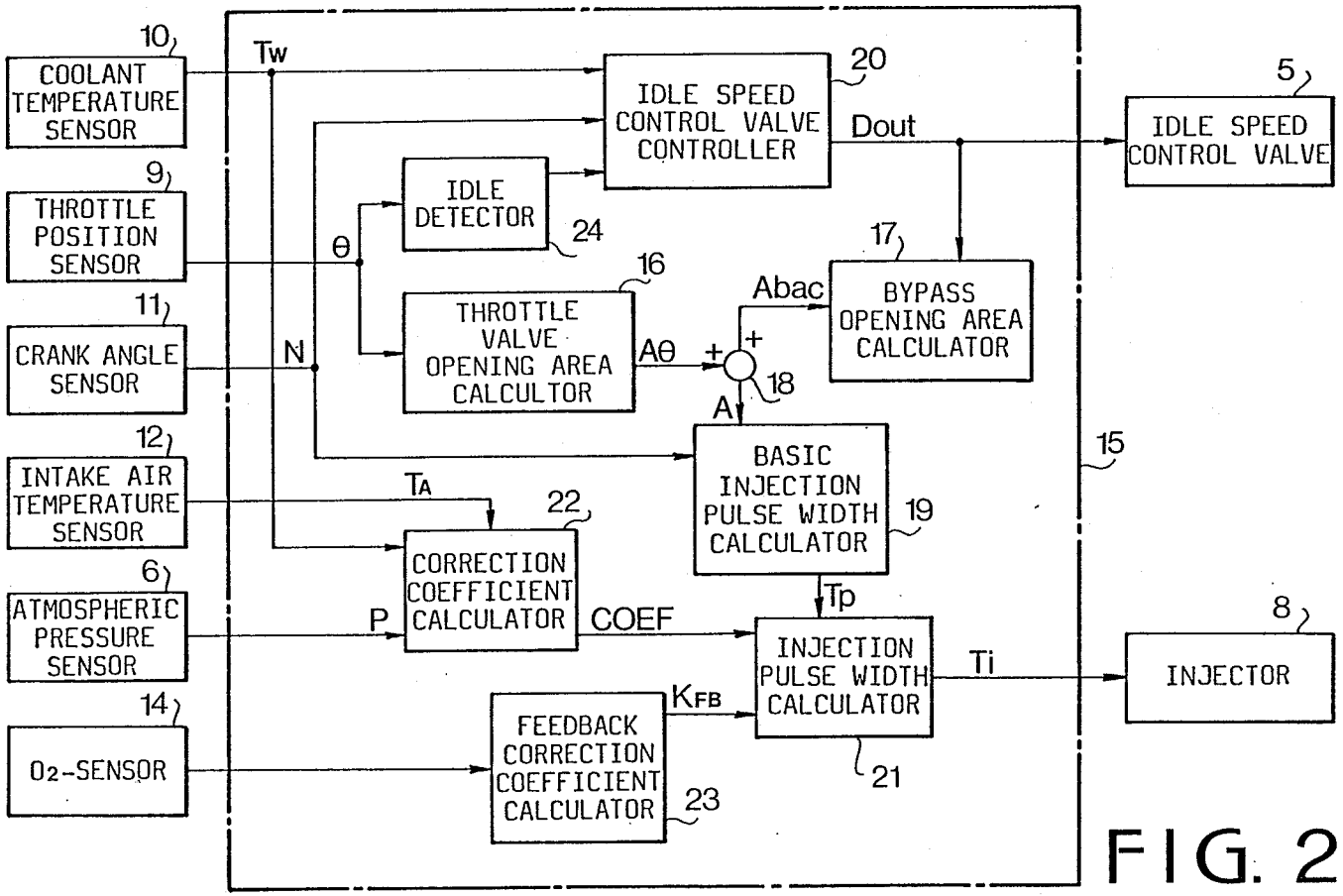
FIG. 2 is a block diagram showing a control unit of the present invention.

Referring to FIG. 2, the control unit 15 has a throttle valve opening area calculator 16 which is applied with a throttle valve opening degree 8 detected by the throttle position sensor 9 and calculates a throttle valve opening area $A\theta$. The throttle opening degree $\theta$ is further applied to an idle detector 24 which determines idling of the engine when the throttle valve closes. An idle signal from the idle detector 24 is applied to an idle speed control valve controller 20 which is also applied with a coolant temperature Tw from the coolant temperature sensor 10 and with an engine speed N from the crank angle sensor 11. The controller 20 has a calculator for providing a control value Dout for the idle speed control valve 5. A basic control value Dtw is derived from a table responsive to the coolant temperature tw from the coolant temperature sensor 10. A feedback control value Dfb is calculated in accordance with the difference between a desired engine speed Nset derived from a table in accordance with the coolant temperature Tw at idling of the engine and the actual engine speed N. A miscellaneous correction coefficient Det is derived from a table in accordance with operation of an air-conditioner and selection of speed gears in a transmission. Thus, the control value Dout is determined from the following equation $$Dout = Dtw + Dfb + Det$$

and the control signal (pulse signal) is fed to the valve 5 to control idling speed of the engine.

In loaded engine operation, since no idle signal is produced from the idle detector, the control value Dout is determined by the basic control value Dtw. At idling of the engine, the control value Dout is controlled such that the engine speed N is converged to the desired engine speed Nset.

The control value Dout is applied to a bypass opening area calculator 17 which calculates an opening area Abac of the bypass 4 in dependence on the control value Dout. Output signals $A\theta$ and Abac from the calculators 16 and 17 are applied to an adder 18 where $A\theta$ and Abac are added to obtain a total opening area A from an equation $A=(A\theta+Abac)$. An output signal A is applied to a basic fuel injection pulse width calculator 19 having a table to which the engine speed N from the sensor 11 is applied. In the calculator 19, a basic fuel injection pulse width Tp is derived from the table in accordance with signals A and N. In the table, a plurality of basic fuel injection pulse widthes Tp calculated based on an equation $$Tp=f((A\theta+Abac),N)$$

are stored. The basic fuel injection pulse width Tp increases with increase of the total opening area A and the engine speed N.

The control unit 15 further has an air-fuel ratio correction coefficient calculator 22 where an air fuel ratio correction coefficient COEF is calculated in dependence on an atmospheric pressure P, a coolant temperature Tw and intake air temperature $T_A$ applied from the sensors 6, 10 and 12. A feedback correction coefficient calculator 23 is provided for calculating a feedback correction coefficient $K_{FB}$, in dependence on an output voltage of the $O_2$-sensor 14.

The corrected basic injection pulse width Tp and coefficients COEF and $K_{FB}$ are applied to an injection pulse width calculator 21 where an output injection pulse width Ti is calculated by the following equation.

$$Ti=Tp\times COEF\times K_{FB}$$

The pulse width Ti is applied to the injectors 8.

Figure 3:
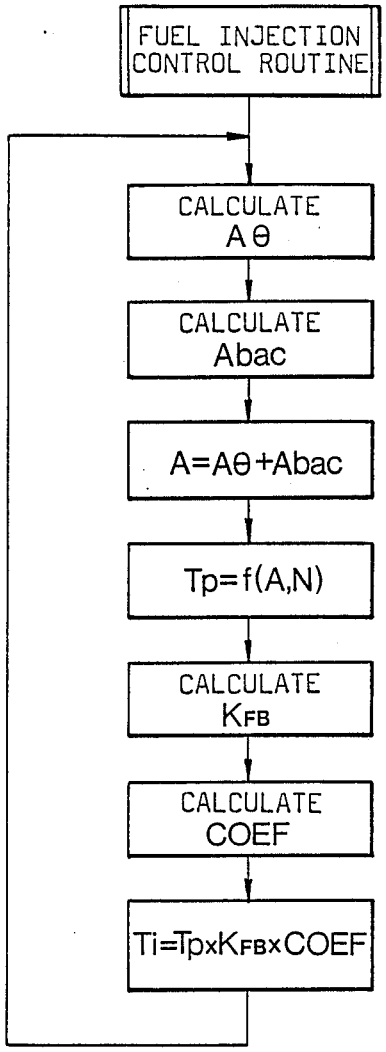
FIG. 3 is a flowchart showing the operation of the system of FIG. 2.

The operation of the fuel injection control is shown in a flowchart of FIG. 3.

Figure 6:
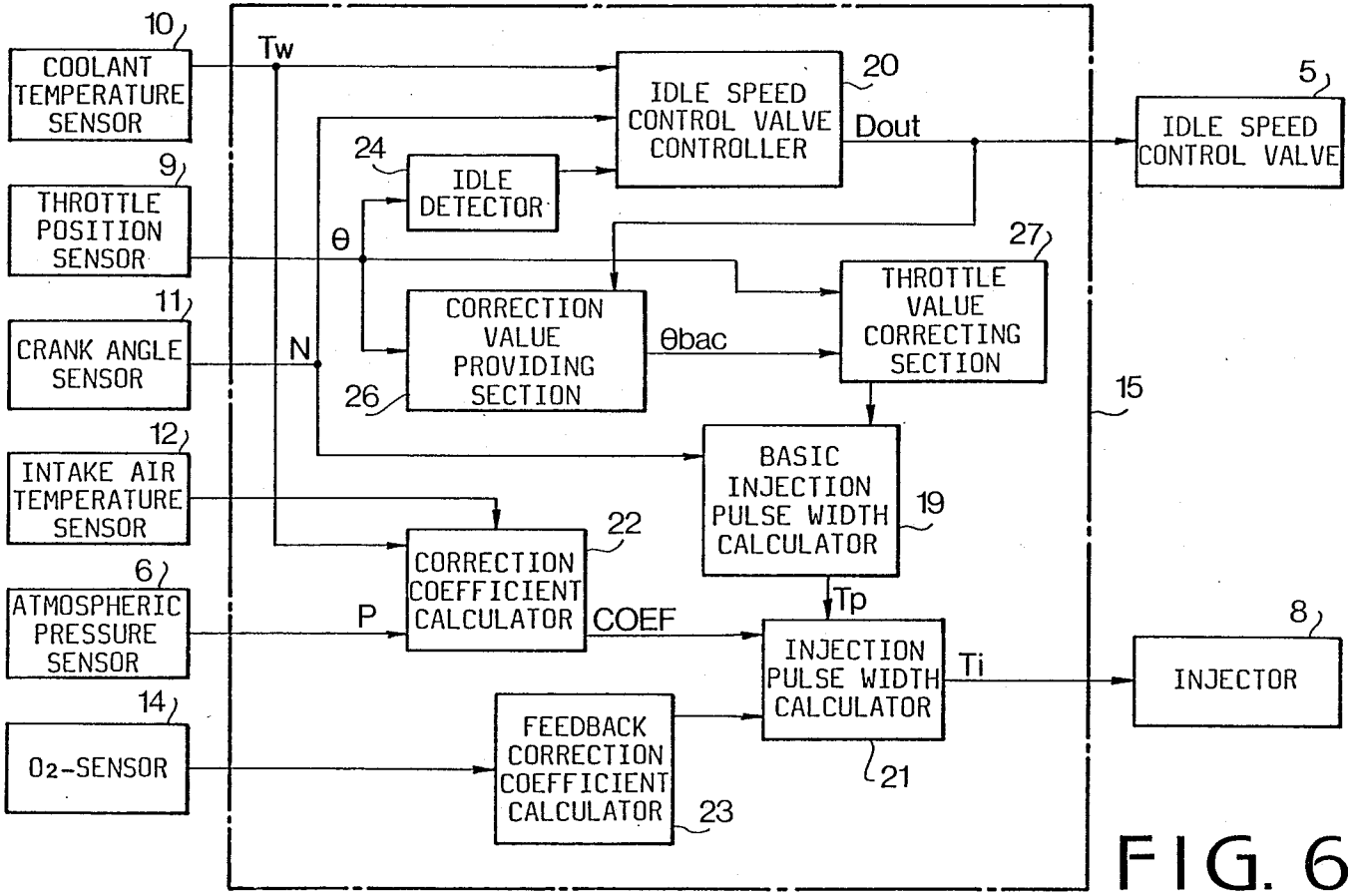
FIG. 6 is a block diagram showing a second embodiment of the present invention.

FIG. 6 shows a second embodiment of the present invention. In the control unit 15 of the second embodiment, a correction value providing section 26 dependent on the throttle valve opening degree $\theta$ is provided. The section 26 has a table from which a correction value $\theta$bac is derived in accordance with the throttle valve opening degree $\theta$ and the control value Dout. In the table, correction values $\theta$bac calculated based on an equation $\theta bac=f(Dout, \theta)$ are stored. When the control value Dout increases, the value $\theta$bac increases, and when the throttle valve opening degree $\theta$increases, the correction value $\theta$bac reduces.

The correction value $\theta$bac is applied to a throttle value correcting section 27. The throttle opening degree $\theta$ applied from the throttle position sensor 9 is corrected by the correction value $(\theta+\theta bac)$. A corrected throttle value is applied to the basic fuel injection pulse width calculator 19 to which the engine speed N is applied. Basic fuel injection pulse width Tp is calculated by an equation $Tp=f((\theta+\theta bac), N)$.

Other structures are the same as the previous embodiment and the same parts thereof are identified with the same reference numerals as FIG. 2.

Figure 7:
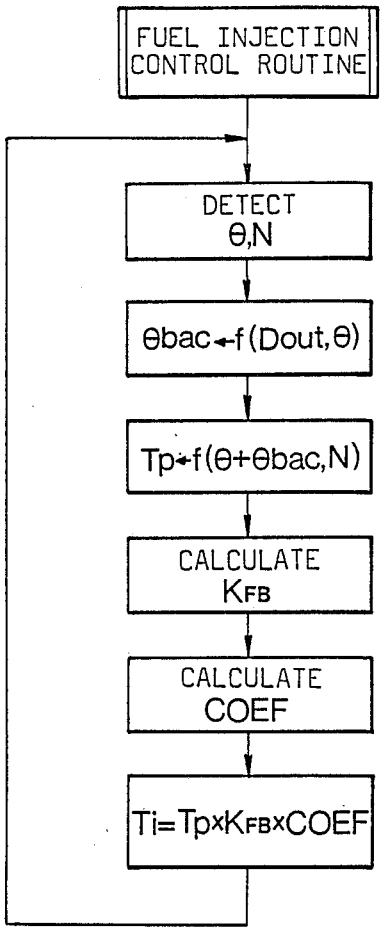
FIG. 7 is a flowchart showing the operation of the system of FIG. 6.

A flowchart of FIG. 7 shows the operation of the system of the second embodiment.

Figure 5:
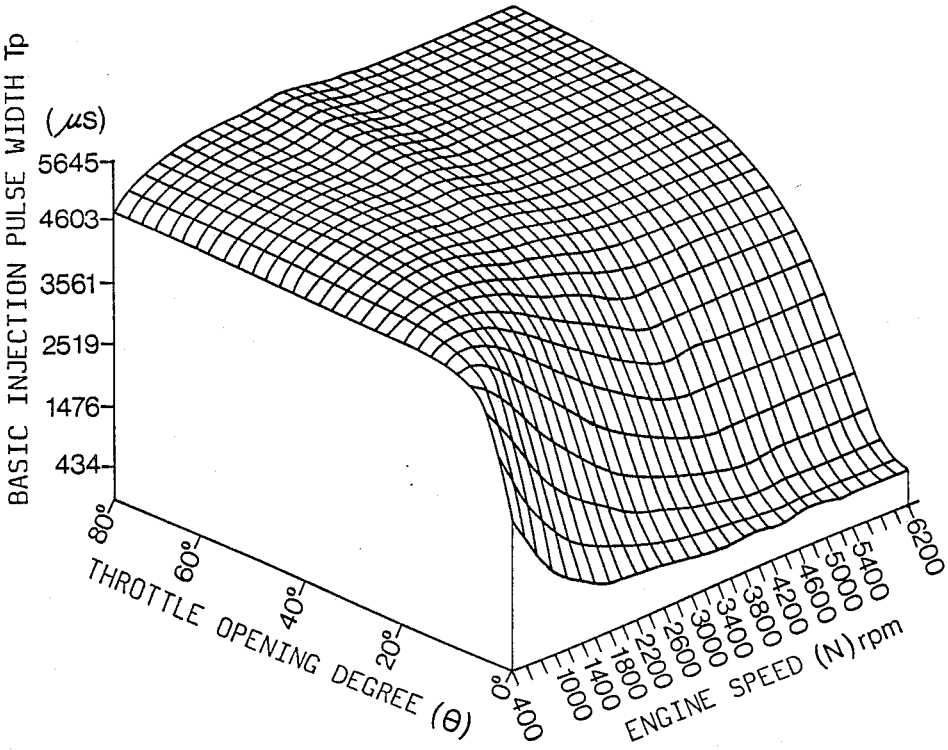
FIG. 5 shows a basic injection pulse width table.
Figure 8:
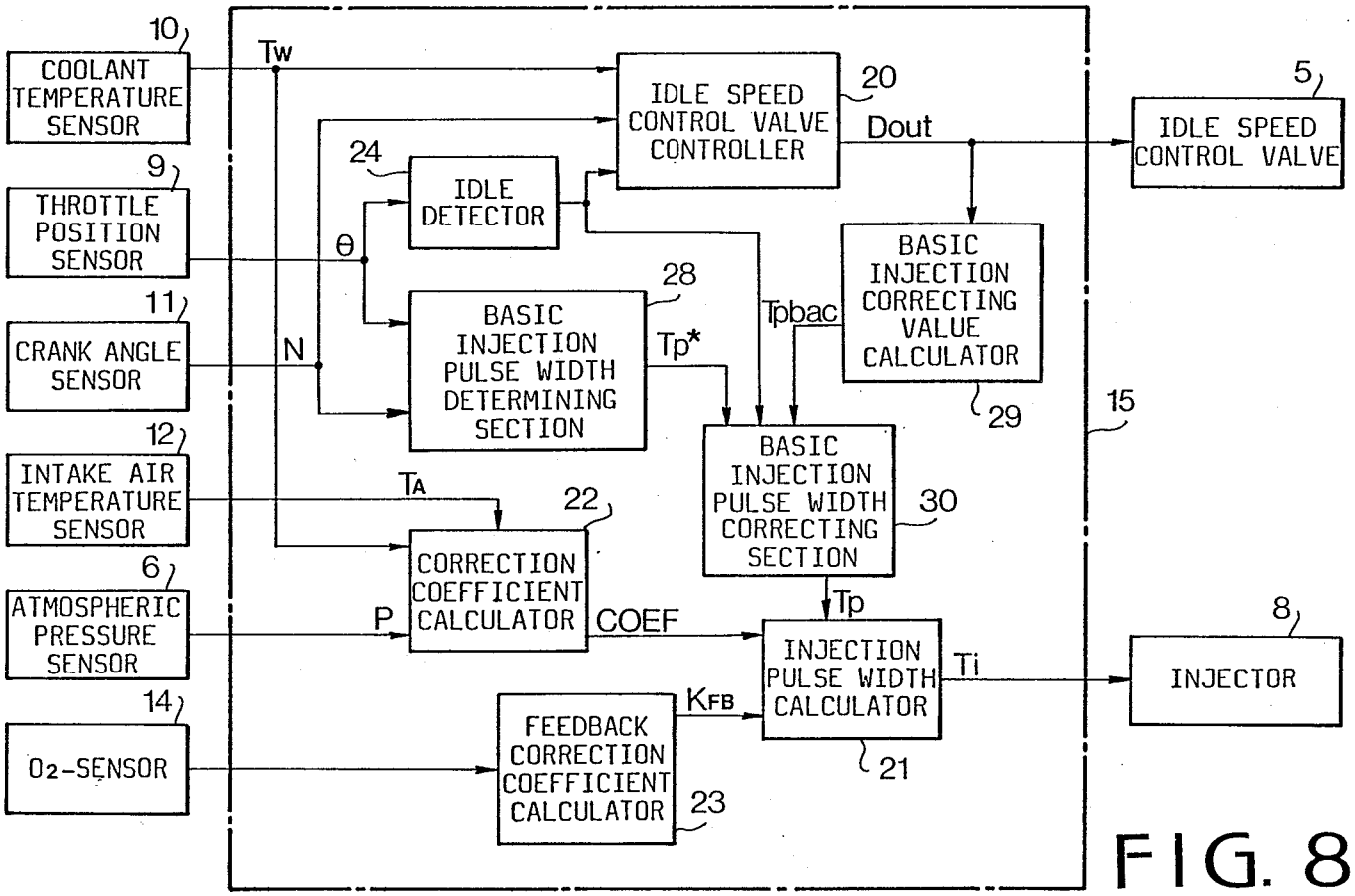
FIG. 8 is a block diagram showing a third embodiment of the present invention.

Referring to FIG. 8 showing a third embodiment of the present invention, the control unit 15 has a basic fuel injection pulse width determining section 28 having a table (FIG. 5) which is supplied with throttle opening degree $\theta$ and engine speed N from sensors 9 and 11 for determining a basic injection pulse width Tp*. A basic fuel injection correcting value calculator 29 is applied with the control value Dout and calculates a correcting value Tpbac in accordance with Tpbac=f(Dout). The correcting value Tpbac is to correct the variation of air-fuel ratio in accordance with the variation of the amount of air flowing in the bypass 4. If the idle speed control valve 5 is operated to increase the amount of air with increase of the control value Dout, the value Tpbac increases as an increasing function of the control value Dout. Output signals from detector 24, section 28 and calculator 29 are applied to a basic injection pulse width correcting section 30. When idling of the engine is detected by the detector 24, the basic injection pulse width Tp* is corrected by correcting value Tpbac to produce a corrected basic fuel injection pulse width Tp as follows, $$Tp=Tp^*+Tpbac.$$

Figure 9:
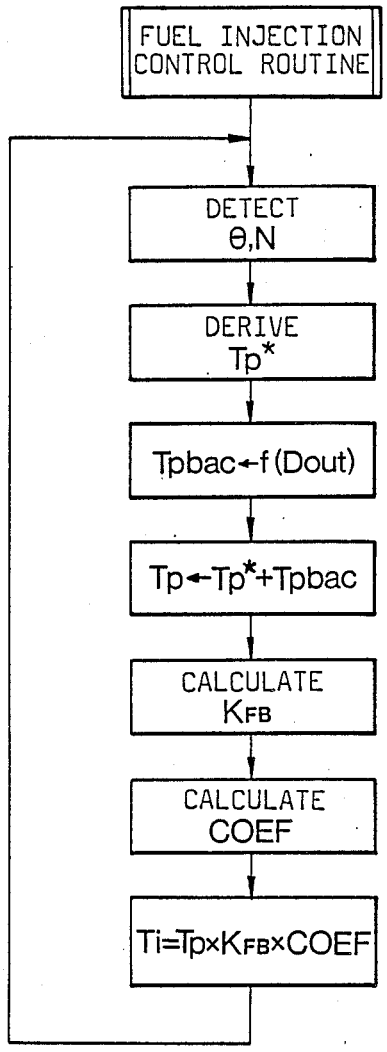
FIG. 9 is a flowchart showing the operation of the system of FIG. 8.

The operation of the system is shown in a flowchart of FIG. 9.

In accordance with the present invention, since the fuel injection pulse width is corrected in accordance with a control value dependent on a signal for the idle speed control valve, the air fuel-ratio is controlled in the entire operating range. Thus, an accurate fuel injection control can be achieved at a low load driving or idling of the engine.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A system for controlling fuel injection of an engine for a motor vehicle having an intake passage, a throttle valve provided in the intake passage, a bypass around the throttle valve, an idle speed control valve provided in the bypass, and at least one fuel injector, comprising:

an engine speed sensor producing an engine speed signal dependent on speed of the engine;

a throttle position sensor producing a throttle opening degree signal dependent on an opening degree of the throttle valve;

determining means for producing a basic injection pulse width signal in accordance with the engine speed signal and throttle opening degree signal;

detector means for detecting idling operation of the engine and for producing an idle signal;

control means responsive to the idle signal and the engine speed signal for producing a control value signal for controlling the idle speed control valve; and correcting means responsive to the control value signal for producing a correction value, and for correcting the basic injection pulse width signal with the correction value and for producing a fuel injection pulse width signal for operating the fuel injector.

2. The system according to claim 1 wherein the correcting means includes throttle valve opening area calculator means and bypass opening area calculator means and an adder for adding outputs of both the calculator means for producing the correction value.

3. The system according to claim 1 wherein the correcting means includes setting means responsive to the throttle opening degree signal for correcting the throttle opening degree signal whereby the basic injection pulse width signal is corrected.

* * * * *